United States Patent [19]

Codding

[11] 4,454,029

[45] Jun. 12, 1984

[54] AGRICULTURAL PRODUCT SORTING

[75] Inventor: Elias H. Codding, Houston, Tex.

[73] Assignee: Delta Technology Corporation, Houston, Tex.

[21] Appl. No.: 267,596

[22] Filed: May 27, 1981

[51] Int. Cl.[3] ..... B07C 5/342

[52] U.S. Cl. ..... 209/581; 209/585; 209/587; 250/226; 356/419; 356/425

[58] Field of Search ..... 209/580, 581, 582, 585, 209/587, 563, 564, 565; 250/252.1, 226; 356/419, 425, 448

[56] References Cited

U.S. PATENT DOCUMENTS

| | | | |
|---|---|---|---|
| 2,759,601 | 8/1956 | Baigent | 209/581 |
| 2,803,754 | 8/1957 | Cox . | |
| 2,803,756 | 8/1957 | Cox . | |
| 2,825,456 | 3/1958 | Cox . | |
| 2,833,937 | 5/1958 | Cox | 209/581 X |
| 2,841,718 | 7/1958 | Hoover . | |
| 2,879,407 | 3/1959 | Cox . | |
| 2,908,375 | 10/1959 | Hoover . | |
| 2,908,388 | 10/1959 | Kaufman . | |
| 2,966,264 | 12/1960 | Cox . | |
| 3,012,666 | 12/1961 | Cox . | |
| 3,053,497 | 9/1962 | Fraenkel . | |
| 3,066,797 | 12/1962 | Fraenkel . | |
| 3,097,744 | 7/1963 | Hutter . | |
| 3,216,567 | 11/1965 | Kelly . | |
| 3,366,236 | 1/1968 | Brazeale . | |
| 3,380,586 | 4/1968 | Frobese . | |
| 3,382,975 | 5/1968 | Hoover | 209/580 X |
| 3,385,434 | 5/1968 | Nelson . | |
| 3,415,496 | 12/1968 | Evans, Jr. . | |
| 3,521,074 | 7/1970 | Frobese . | |
| 3,565,249 | 2/1971 | Codding . | |
| 3,636,462 | 1/1972 | Baldauf, Jr. . | |
| 3,709,612 | 1/1973 | Clemens | 356/425 X |
| 3,738,484 | 6/1973 | Hoover et al. . | |
| 3,750,881 | 8/1973 | Husome et al. . | |
| 3,782,544 | 1/1974 | Perkins . | |
| 3,867,039 | 2/1975 | Nelson . | |
| 3,890,221 | 6/1975 | Meuhlethaler . | |
| 3,899,415 | 8/1975 | Codding | 209/581 |
| 3,914,601 | 10/1975 | Hoover et al. | 209/587 X |
| 3,980,181 | 9/1976 | Hoover . | |
| 3,998,555 | 12/1976 | Babb | 356/419 X |
| 4,057,146 | 11/1977 | Castaneda et al. | 209/581 |
| 4,074,808 | 2/1978 | Gillespie et al. | 209/587 |
| 4,132,314 | 1/1979 | von Beckmann et al. | 209/582 X |
| 4,170,306 | 10/1979 | Marshall et al. | 209/582 X |
| 4,186,838 | 2/1980 | Levitt et al. | 209/581 |
| 4,203,522 | 5/1980 | Fraenkel et al. | 209/581 X |
| 4,235,342 | 11/1980 | Braham | 209/582 X |
| 4,239,118 | 12/1980 | Lockett | 209/582 X |
| 4,241,835 | 12/1980 | Lockett | 209/582 |
| 4,260,062 | 4/1981 | Lockett . | |
| 4,271,968 | 6/1981 | Mehrkam et al. . | |
| 4,281,765 | 8/1981 | Brazell et al. . | |
| 4,296,320 | 10/1981 | Miller | 250/252.1 |
| 4,302,769 | 11/1981 | Andry et al. . | |
| 4,308,959 | 1/1982 | Hoover et al. . | |
| 4,344,539 | 8/1982 | Lockett . | |

*Primary Examiner*—Robert B. Reeves
*Assistant Examiner*—Edward M. Wacyra
*Attorney, Agent, or Firm*—Pravel, Gambrell, Hewitt, Kirk & Kimball

[57] ABSTRACT

A bichromatic sorter for agricultural products such as coffee beans, peanuts, beans and other types of agricultural products is provided to sort and reject undesired product based on color characteristics of the product in at least two component colors. Problems of synchronization between component color signals are overcome by the optical scanning portion of the sorter. The complexity of the electronics portion of the sorter is materially reduced by multiplexing or time sharing certain functions the electronics must perform.

19 Claims, 11 Drawing Figures

AGRICULTURAL PRODUCT SORTING

BACKGROUND OF THE INVENTION

1. Field of Invention

The present invention relates to optical/electronic sorting of agricultural products.

2. Description of Prior Art

In U.S. Pat. No. 3,012,666 a technique of electronic color sorting of agricultural products was disclosed. Color masks defining limits between acceptable and unacceptable colors for the product as a relative mixture of two component colors were electronically formed. Agricultural products were optically scanned to measure the relative presence of these component colors, and the measurements taken were compared with the limits defined by the color masks. Products with colors found unacceptable were then separated.

As pointed out in U.S. Pat. No. 3,899,415, in actual use sorters using the foregoing color sorting technique in service often encountered several factors which would cause the limit settings to fluctuate. To compensate for this, an adjustment, known as normalization, of the electronic settings for acceptable color was periodically made with a normalizing cicuit. According to this patent, however, a separate normalizing circuit for component color and for each optical sensor was needed. This significantly increased the number of electronic components in the sorter. Since these types of sorters often were required to perform in remote areas of underdeveloped nations and under harsh service conditions, reliability of the sorter and maintenance and the availability of replacement parts were frequently encountered problems.

Further, it was necessary to insure that the color component signals being processed at any particular time came in actuality from the same scanned portion of the product, requiring synchronization of the receipt and processing for each of the component color signals received from the optical scanning portion of the apparatus. Again, harsh service conditions often in remote locales made this a substantial problem.

U.S. Pat. Nos. 3,066,797 and 3,993,899 used light conducting members as fiber optic bundles in sorters of this type. The bundles of fiber optic material were divided into groups of bundles, one for each component color, and each group passed through a different color filter to a photocell to separate for processing the color components of the object being scanned. Physical division of the fiber optics into bundles, however, accentuated the framing problems. Each optical fiber in effect faced one portion of the surface of the object being scanned. When this fiber was separated into one of the color groups, however, only that color component of that surface area of the product was available for processing and comparison. The use of small diameter optic fibers was mentioned, but this increased the cost of the sorter. Another possibility discussed was random distribution of the fibers for the different colors within the bundle.

SUMMARY OF THE INVENTION

Briefly, the present invention provides a new and improved sorting apparatus which sorts agricultural products into acceptable and unacceptable categories based on color characteristics of the products. The products are fed from a hopper through a chute or conduit past a zone of illumination in a chamber. Optic fibers sense the light reflected and form a framed image of successive portions of the product in the zone of illumination. The sensed light in the optic fibers is then optically divided or split into at least two color illumination level components, which are converted into electrical signals. The component level electrical signals are compared with reference levels in a processing circuit to determine if the color of the product is within acceptable limits. Unacceptable ones of the product are then separated from those which are acceptable. By framing the image of the product before splitting it into component colors, the need for mechanical adjustment of the optics to synchronize presentation of the color images to the processing circuit is removed.

Plural light sensors are used about the zone of illumination to insure that the framed image extends about a complete band of the product. In the processing circuit, the illumination component level signal for each of the sensors is compared with a reference level. The reference level for each of the component level signals of each of the plural sensors is individually adjusted based on sampled light conditions in the zone of illumination to adjust for variations in background light in the zone of illumination and variations in parameters of the electronics and optics of the apparatus. Adjustment of the reference levels of the component level signals is done in a cyclic scan sequence, simplifying and reducing the number of electronic components required in the apparatus.

DESCRIPTION OF THE PREFERRED EMBODIMENT

Figure 1:
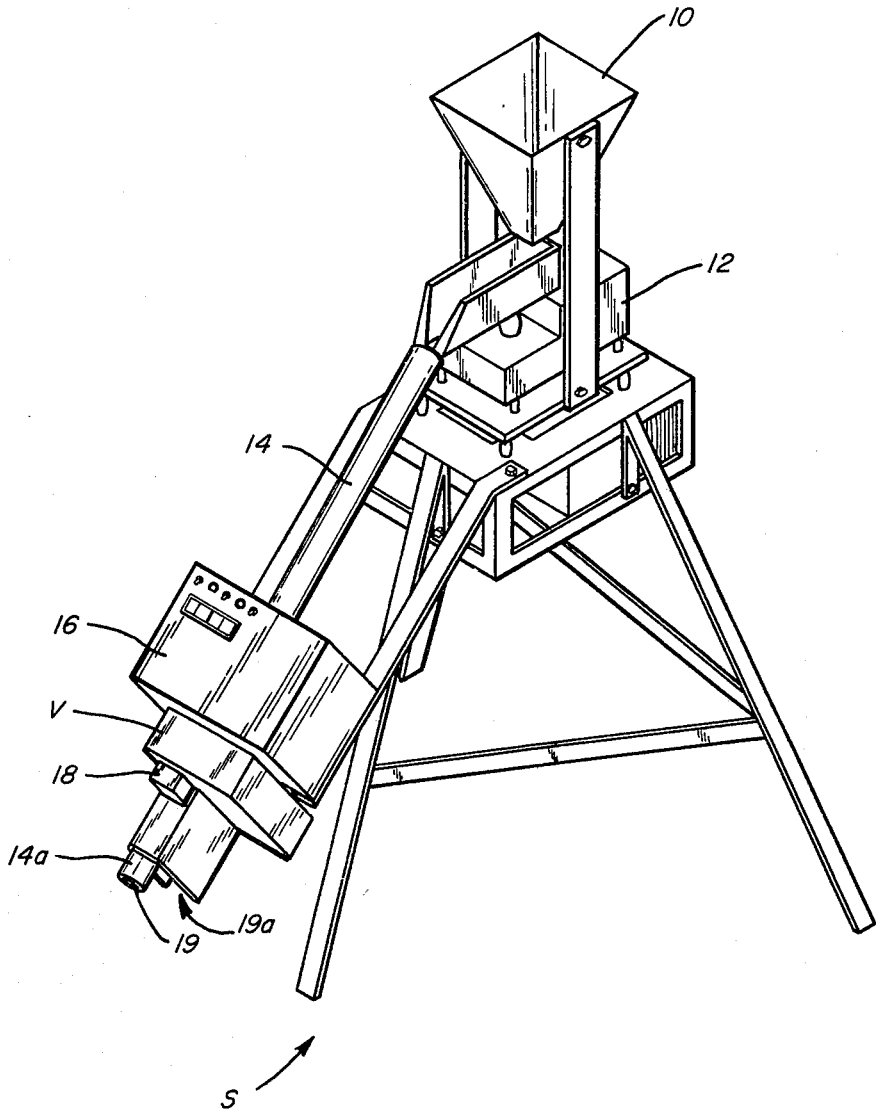
FIG. 1 is an isometric view of a sorting apparatus of the present invention.

In the drawings, the letter S designates generally a sorting apparatus in accordance with the present invention. The sorter S (FIG. 1) sorts agricultural products into acceptable and unacceptable categories based on color characteristics of the products. The agricultural products may be, for example, coffee beans, other types of beans, peas, or peanuts, as well as other fruit and vegetable or other products.

The products to be sorted are received in a hopper 10 (FIG. 1) at an upper portion of the sorter S. The products move from the hopper 10 under the influence of a vibratory feeder 12 to a chute or conduit 14. The feeder 12 further functions to form the product to be sorted into a single stream as the products enter the chute or conduit 14. The product descends through the conduit 14 past a zone of illumination within a viewing station V. In the sorter S, the feeder 12 is periodically disabled to clear chute 14 and a blast of air blown through the viewing station V to clear the viewing station V of dust or other debris as best can be done.

Individual ones of the product are illuminated by a suitable number of light sources spaced about the periphery of the viewing station V so that all surface portions of the product are illuminated as the product passes through the viewing station. Light reflected from illuminated portions of the surface of the product is received in a suitable number of optical sensor stations O. The number of optical stations O for the viewing station V is typically equal to the number of light sources in the viewing station V. For example, three optical stations O, functioning as separate channels, are spaced at one-hundred twenty degree intervals with respect to the center of the viewing station V. It should be understood, however, that other numbers of stations may be used as well.

The optical stations O are optically coupled, in a manner to be set forth, to an electronic processing circuit P (FIGS. 5 through 9) contained in an electronics housing 16 (FIG. 1). In the processing circuit P, component level signals are compared with established reference levels to determine if the color of the individual ones of the product being viewed by the optical station O is within acceptable limits. When the color of individual ones of the product is not within acceptable limits, an ejector 18, typically pneumatic, is activated by the processing circuit P to separate the unacceptable ones of the product from those which are acceptable. Acceptable product passes from an opening 19 at lower end 14*a* of the chute into a suitable container, while unacceptable product is moved by ejector 18 as it falls to pass from an opening 19*a*, spaced from the opening 19, into a separate container.

Figure 3:
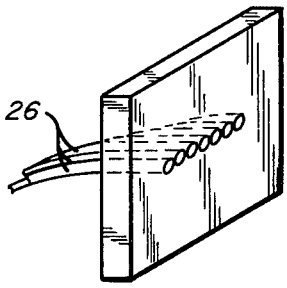
FIGS. 3 and 4 are isometric views of portions of the optical components of FIG. 2.
Figure 2:
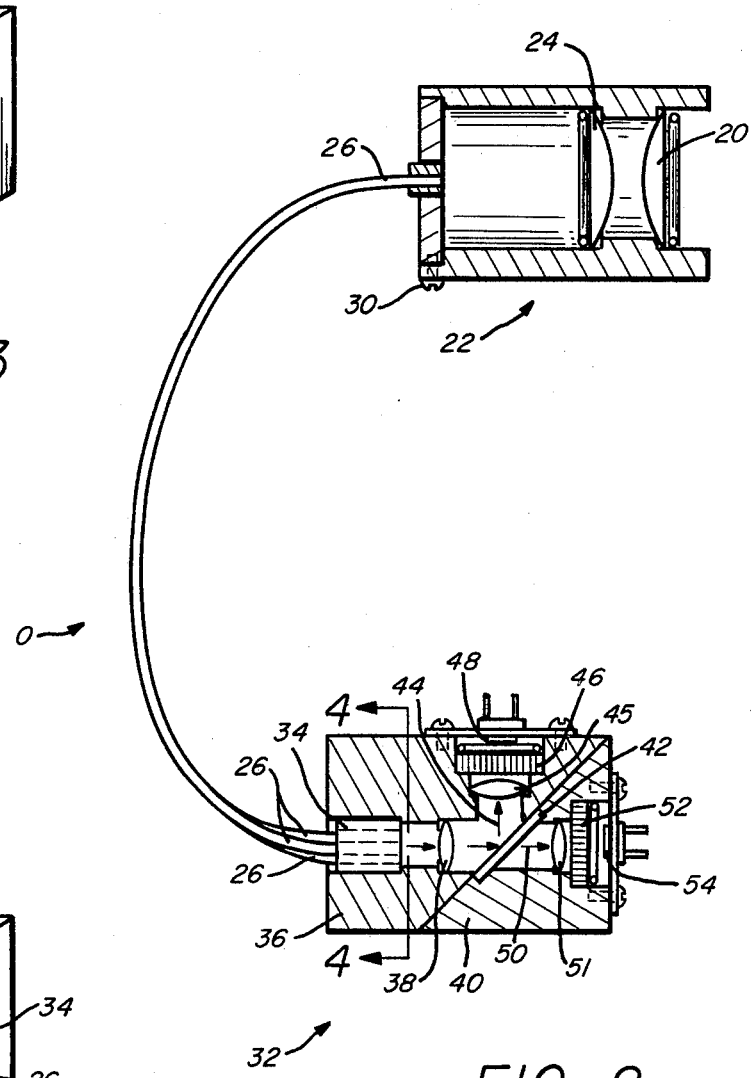
FIG. 2 is an elevation view, taken partly in cross section of optical components of the sorter of FIG. 1.
Figure 4:
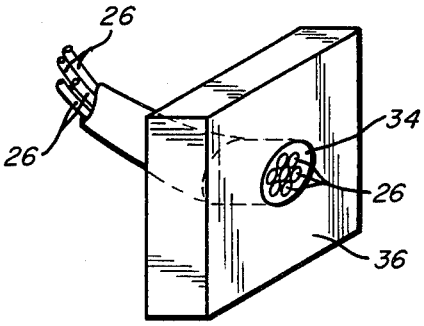
Figure 5:
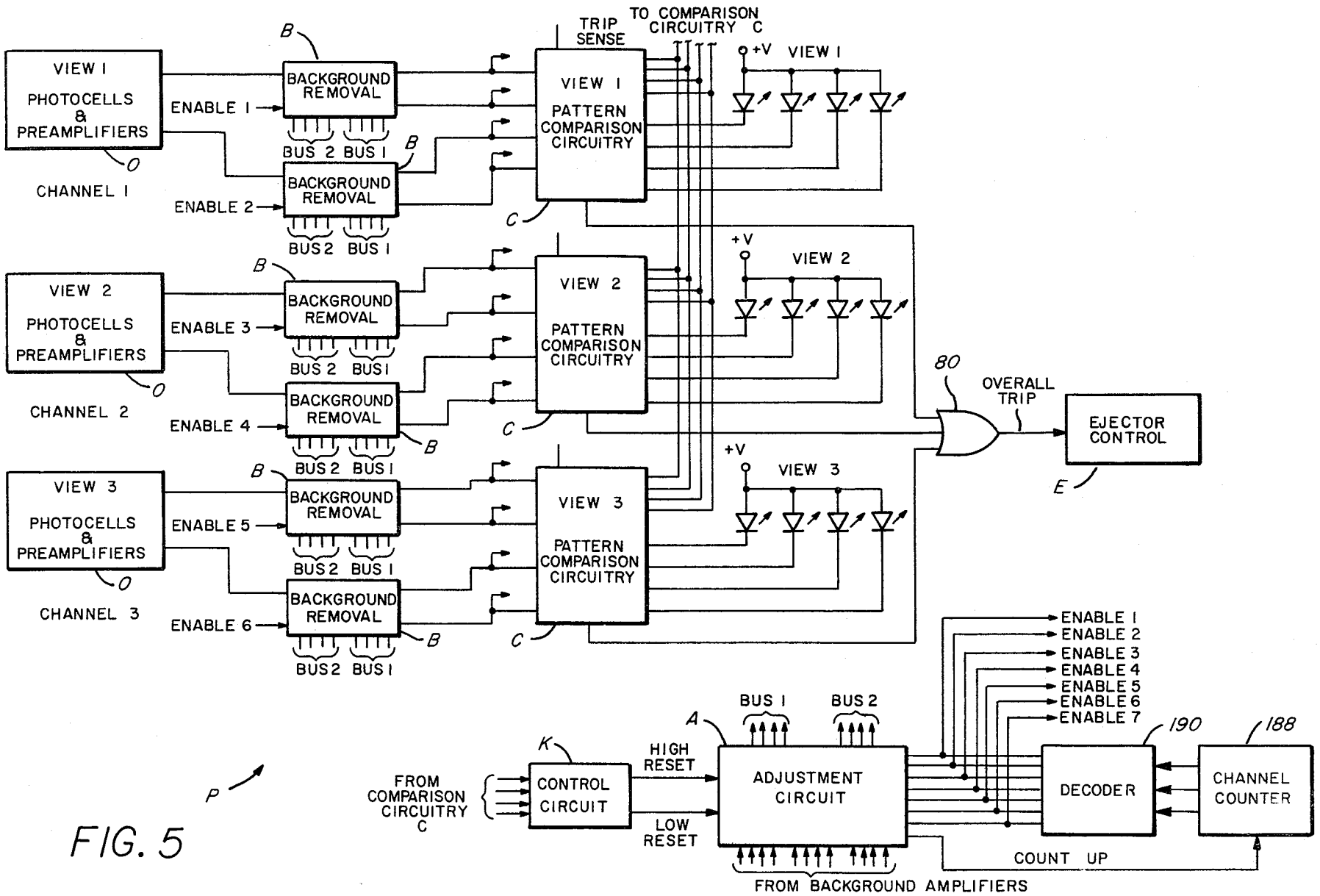
FIG. 5 is schematic electrical circuit diagram of an electronic processing circuit of the present invention.

Considering the optical system O (FIG. 2) more in detail, each of the optic stations O is of like construction and operation and thus the details of operation of only one are set forth in the drawings (FIGS. 2–4). In the optic station O, a first lens 20 of a framing assembly 22 senses light conditions in the viewing station V as the product stream falls under the influence of gravity through the chute 14. The lens 20 focuses the light through a second lens 24 onto a plurality of optic sensors in the form of optic fibers 26 arranged in a plane along a rear wall 28 of the framing station 22. The focal length of lenses 20 and 24 are preferably selected to offer a reduction in size of the product. A set screw 30 is provided in the framing station 22 so that minor adjustments in the position of the optic fibers 26 with respect to the lens 24 may be made for alignment and focusing purposes.

Lenses 20 and 24 receive light which is composed of background light reflected from a reference or standard, located on an opposite side of the viewing station from the framing station 22, and light reflected from any portion of one or more items of product present before the framing station 22. Lenses 20 and 24 transmit light from the viewing station V onto the fibers 26 in such a manner that for large items of product successive portions of these items of the product are scanned or framed as the items descend past framing station 22. The sufface area of an item or items of product sampled by one framing station 22 would thus be composed of a sequence of several such frames formed in station 22. However, each frame in a sequence is separately processed in the processing circuit P so that items with unacceptable color spots on small areas of their surface may be detected and sorted out from acceptable items. For smaller type items of product, the entire item may be framed at one time.

Figure 6:
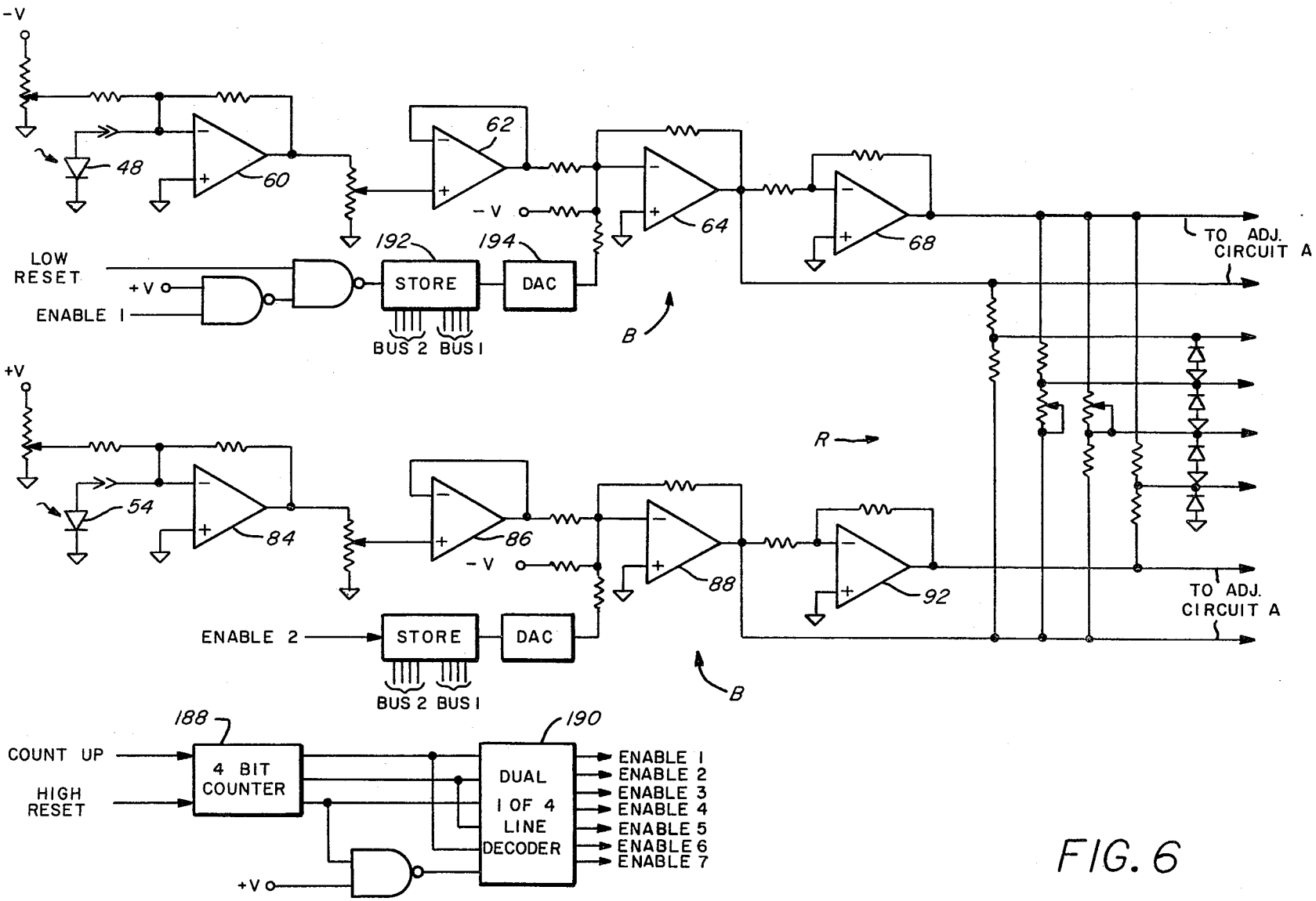
FIGS. 6, 7, 8 and 9 are schematic electrical circuit diagrams of portions of the circuit of FIG. 5.
Figure 7:
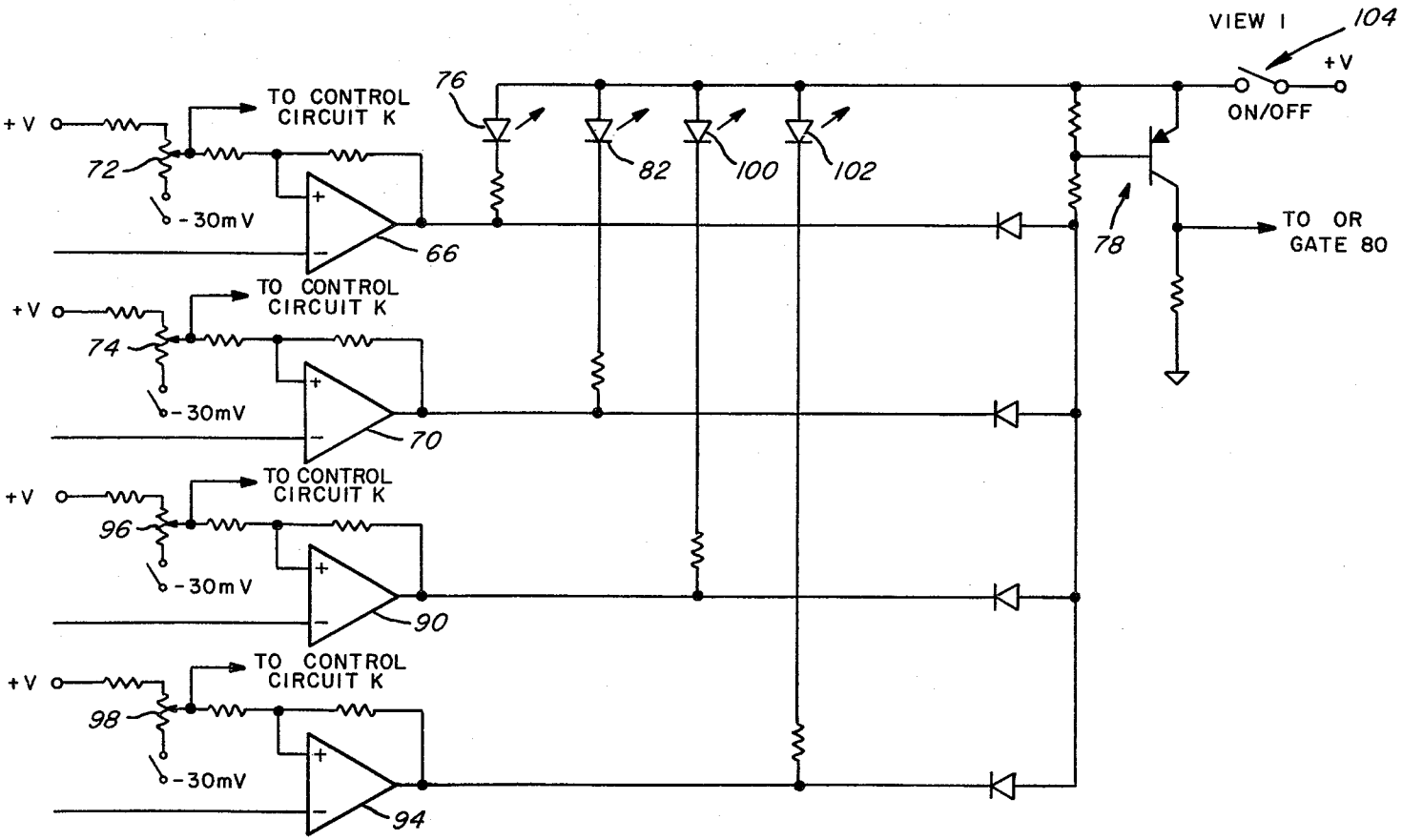

The optic fibers 26 extend from and transport light sensed from the framed portions of the product to an optical dividing lens 32. The optical dividing lens 32 is optically coupled to the optic fibers 26 and divides the sensed light from the product present in the viewing station into plural color illumination level components. The optic fibers 26 are arranged at the optical divider 32 so that at least one of such fibers is centrally located (FIG. 4) in a rear mounting member or insert 34, with the remaining ones of the fibers 26 wrapped in a circular fashion about the central fiber or fibers. The mounting member 34 of the optical divider 32 is mounted in a first body portion 36 of the optic divider 32. Light from the optic fibers 26 representing sensed light from the framed portion of the product is received by a focusing lens 38 mounted in a second body portion 40 of divider 32 onto an optic splitter, such as half-silvered mirror member 42. A portion of the light is reflected by the mirror 42 and passes in a direction indicated by an arrow 44 through a lens 45 and a filter 46 which is adapted to pass light of a first color such as blue onto a photodiode 48 of the processing circuit P (FIGS. 2 and 6). A portion of the light passes through the optic splitter mirror 42, as indicated by an arrow 50, through a lens 51 and a filter 52, which is adapted to pass light of a second and different color such as red onto a photodiode 54 of the processing circuit P. It should be understood that the colors red and blue for filters 46 and 52 are given only by way of example and that other colors may be selected depending on the type of product being sorted and the type of optic splitter used.

In the processing circuit P, a comparator circuit C for each color component of each of the plural optic stations O compares the component level signal with a reference level to determine if the color of the portion of the product presented to the optical sensor O is within acceptable limits. If the portion presented to the optical sensor O is not within acceptable limits, the ejector 18 is activated to separate the unacceptable product from the otherwise acceptable ones of the product.

In the processing circuit P, a comparator circuit C (FIG. 7) compares the component level signal with a background adjusted reference level to determine if the color of the portion of the product presented to the sensor is within acceptable limits. The background adjustment is done to compensate for variations in optical conditions in the viewing station V caused by dust and the like and for variations in electronic parameters and tolerances due to heat and other conditions. The component level sensed signal presented to the comparator circuit C has been reduced in a backgroudd reduction circuit B (FIG. 6) prior to comparison with the reference level. Cyclically and periodically, under control by an operation control circuit K (FIG. 5) the feeder 12 is disabled, and light conditions in the viewing station V are sampled by the optic system O in the absence of product to obtain a background reference illumination level In the event that the background level signal has departed from an established normal setting, the background reference level is re-calibrated in an adjusting circuit A. During such re-calibration, the adjusting circuit A is electronically connected in a sequence to the background reduction circuit B for each color component of each optical sensor station O. A particular reduction circuit B remains connected to the adjusting circuit A for a period of time to ascertain that such a reduction circuit is within a normal setting, or if it is out of normal setting, until it has been adjusted to such a state. A new background reduction circuit B is then electronically connected to the adjusting circuit A by the control circuit K. The adjusting process continues in such a sequence until all background reduction circuits have been adjusted to a normal setting. By sequentially electronically connecting the various background circuits B to a single adjusting circuit A according to the present invention, a substantial reduction in parts is afforded.

In the processing circuit P, the photodiode 48 is electrically connected through a preamplifier 60 (FIG. 6) to a buffer amplifier 62. The electrical signal at the output of the buffer-amplifier 62 represents the illumination component level or intensity of a particular color component, in this instance blue, sensed by the photodiode 48 in the viewing station V. The output signal from the buffer amplifier 62 is furnished to a background component removal amplifier 64 of the background removal circuit B. The background removal amplifier 64 removes background reference illumination levels from the component level signal presented thereto and furnishes a component level signal to a color mixing matrix R of the comparator circuit C and to the adjusting circuit A (FIG. 8) directly. An inverter 68 (FIG. 6) is connected to the amplifier 64 to furnish an inverted illumination level signal to the color mixing matrix R of the comparator circuit C and directly to the adjusting circuit A. The outputs of amplifiers 64 and 68 are furnished through the resistor mixing matrix circuit R (FIG. 6) which forms an electronic color mix mask in the manner of U.S. Pat. No. 3,012,666. The mixing matrix R also receives signals from the other background circuit B for the other color light filter for a particular channel. The mixing matrix R, in the manner of U.S. Pat. No. 3,012,666, forms four color mixture levels for the comparator circuit C. The comparator amplifiers 66 and 70 in circuit C compare two of the four color mixture level signals furnished thereto from the matrix R with color mixture reference reference levels set by potentiometers 72 and 74, respectively.

In the event the color mixture level presented to comparator 66 is not within the color mixture reference level furnished thereto, indicating that the color of the product is unacceptable, such as being too light in color, comparator 66 furnishes an output signal energizing an indicator light emitting diode 76 and activating a transistor 78. Transistor 78 when activated sends a trip signal through an OR gate 80 (FIG. 5) to an ejector control circuit E (FIGS. 5 and 9) which causes the ejector 18 to separate the unacceptable product. In the event the illumination level presented to the comparator amplifier 70 is not within the set color mixture reference level furnished thereto, again indicating that the color of the product is unacceptable, such as being an undesirable reddish-yellow, an output pulse is formed by the comparator amplifier 70 energizing a light emitting diode 82 and activating the transistor 78, again causing a trip signal to be sent through the OR gate 80 the ejector control circuit E.

The photodiode 54 (FIGS. 2 and 6) is electrically connected through a preamplifier 84 to a buffer amplifier 86. The electrical signal at the output of buffer amplifier 86 represents the illumination component level or intensity of a particular color component, such as red, sensed by the photodiode 54 in viewing station V. The output signal from the buffer amplifier 86 is furnished to a background removal amplifier 88 of background removal circuit B. Background removal amplifier 88 removes background reference illumination levels from the component level signal presented thereto and furnishes a red component level signal to the mixing matrix R and to the comparator circuit C.

An inverter 92 is connectdd to the amplifier 88 to furnish an inverted red illumination level signal to the mixing matrix R into the comparator circuit C. Comparator amplifiers 90 and 94 in circuit C compare the remaining two color mixture level signals furnished thereto from matrix R with color mixture reference levels set by potentiometers 96 and 98, respectively.

In the event the color mixture level presented to comparator 90 is not within the color mixture reference level furnished thereto, indicating that the color of the product is unacceptable, such as being too dark red, comparator 90 forms an output signal energizing an indicator light emitting diode 100 and activating the transistor 78, sending a trip signal to the ejector control circuit E in the manner set forth above.

Should the color mixture level presented to the comparator 94 not be within the color mixture reference level furnished thereto, indicating an unacceptable color product, such as being too dark in overall color, comparator 94 forms an output signal energizing a light emitting diode 102 and activating the transistor 78. If desired, the operation of the entire first viewing channel may be inhibited by a control switch 104 (FIG. 7) which inhibits the operation of the transistor 78.

Figure 8:
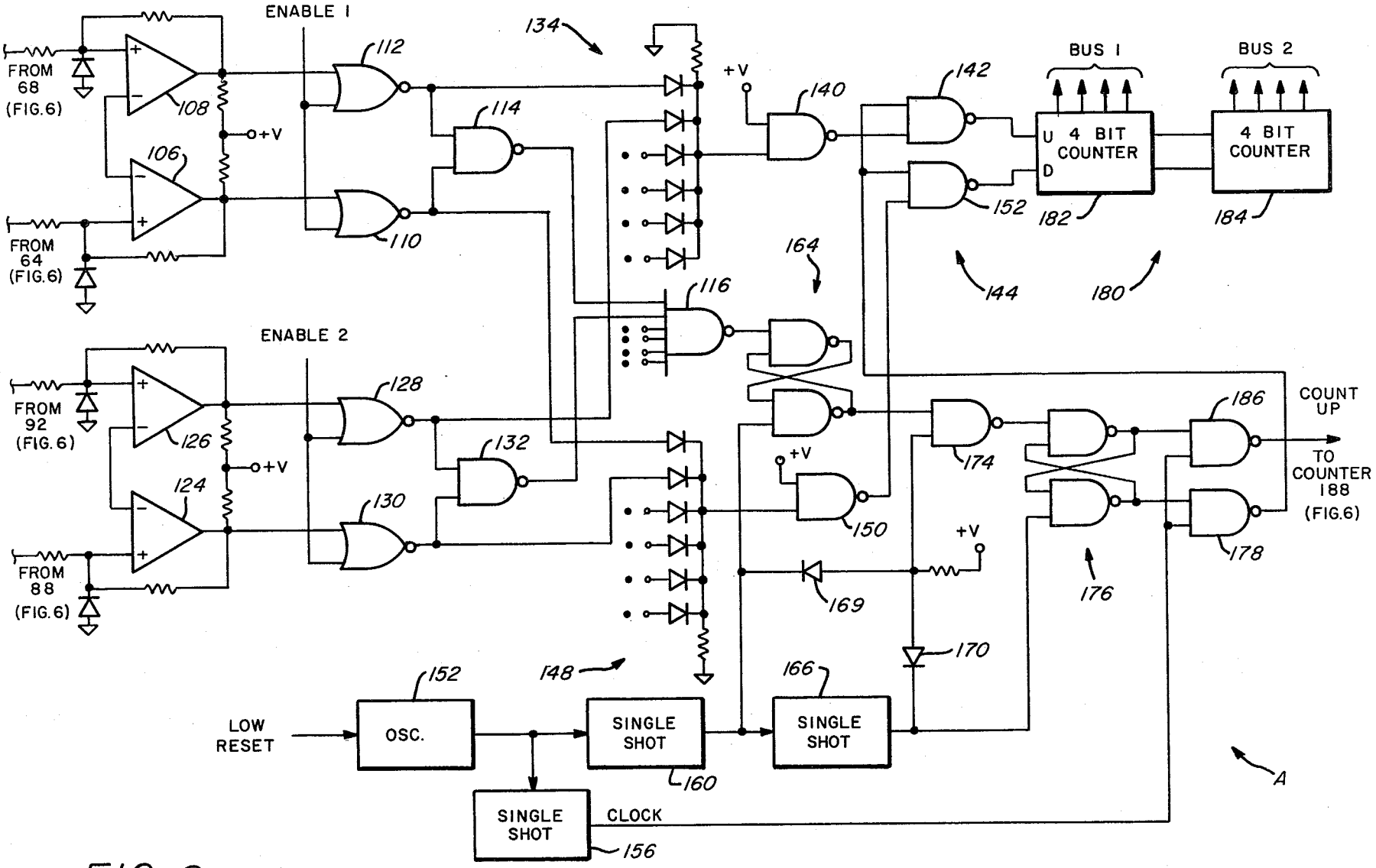
Figure 9:
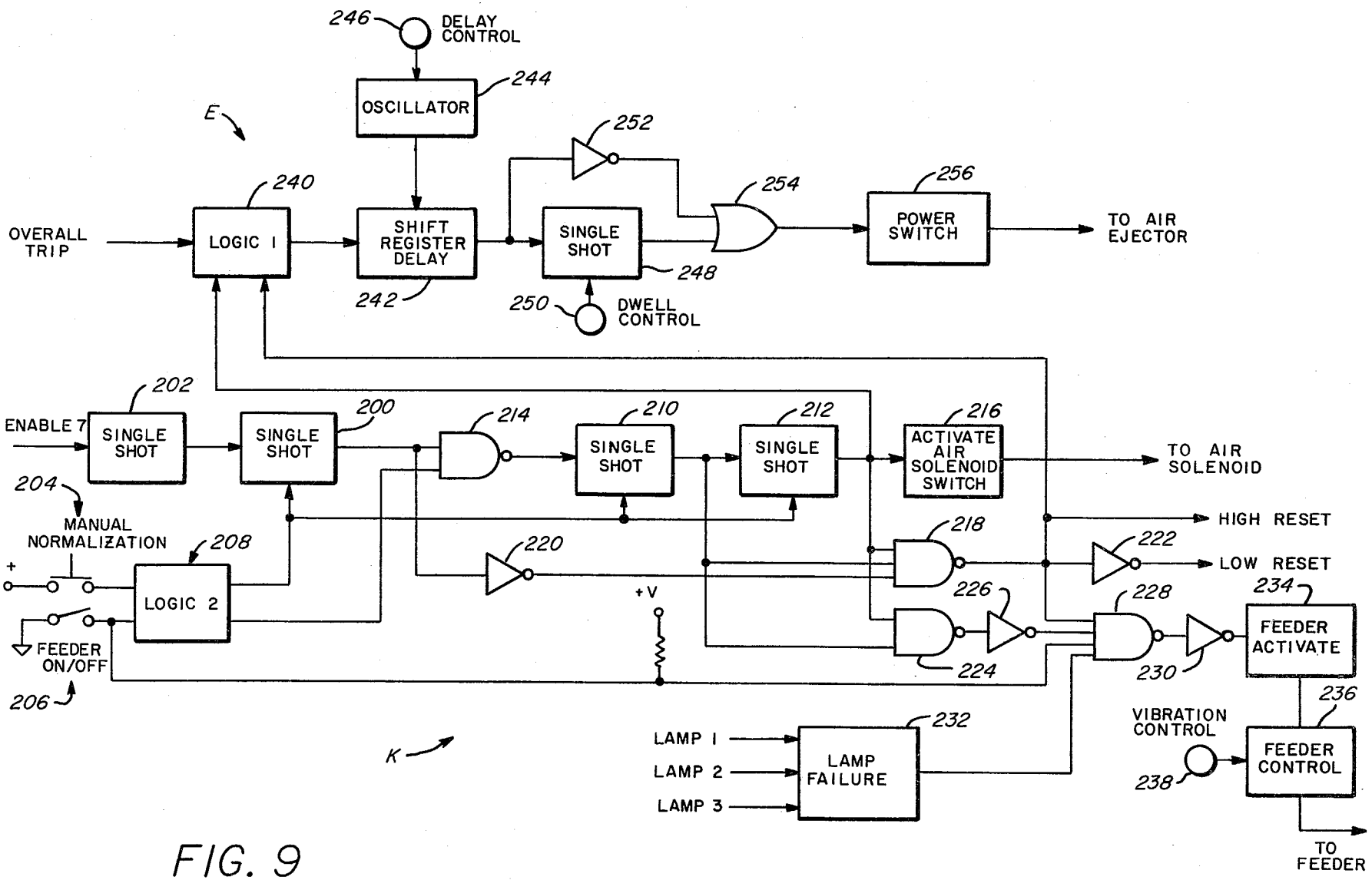

The output from the background removal amplifier 64 is also furnished to a level detector 106 of the adjusting circuit A (FIG. 8). Similarly, the output from inverter 68 is furnished to a level detector 108 of the adjusting circuit A. Level detector 106 is connected to a NOR gate 110, while level detector 108 is connected to a NOR gate 112. Gates 110 and 112 function as sampling gates and electronically scan the status of level detectors 106 and 108, respectively, in response to an Enable 1 pulse (FIG. 10) formed in a control circuit K in a manner to be set forth.

In the event level detector 106 or 108 detects a setting of the background signal for the amplifier connected thereto which is out of a normal range, the NOR gate associated therewith changes output state, a condition which is detected by a NAND gate 114 and provided to a first input of detector NAND gate 116. Since only one Enable pulse is formed at any particular time, only one set of sampling gates, such as gates 110 and 112, is electronically connected through to the detector NAND gate 116 at any time.

The output from the background removal amplifier 88 is also furnished to a level detector 124 of the adjusting circuit A. Similarly, the output from the inverter 92 is furnished to a level detector 126 of the adjusting circuit A. Level detector circuit 124 is connected to a NOR gate 130 while level detector circuit 126 is connected to a NOR gate 128. Gates 128 and 130 function as sampling gates and scan the status of the level detectors 124 and 126, respectively, in response to an Enable 2 pulse (FIG. 10) formed in the control circuit K. In the event either level detector 124 or 126 detects a setting of background signal for the amplifier connected thereto which is out of a normal range, the NOR gate associated therewith changes output state. A NAND gate 132 connected to a second input of the detector NAND gate 116 indicates such a change of state.

The level detector amplifiers of the adjusting circuit A change status to a high output status if the background removal amplifier connected thereto is out of its normal range. Thus, when the status of the level detector amplifiers in the adjusting circuit A are checked by the Enable pulses, NAND gate 114 or 132, as the case may be, transits to a high status so that an input signal is provided to the NAND gate 116 indicating a high status to the gate 116 if the amplifier being re-calibrated is not in tolerance.

The sampling NOR gate 110 for an above limits indication from background removal amplifier 64 is connected to a first diode of a bank of parallel connected diodes 148. The sampling NOR gate 112 for the indication of a below limits condition from background removal amplifier 64 is connected to another diode in the parallel diode bank 134. Similarly, sampling gates for the remaining two channels indicating above and below limit conditions in the particular background removal amplifiers connected thereto are connected to the remaining of the parallel connected diodes.

In the event that any of the background removal amplifiers are indicated to be below normal limit background conditions, the diode in the bank 134 of parallel connected diodes associated therewith is rendered nonconductive, causing an inverting NAND gate 140 to enable a down count control gate 142 of a down/up selector gate pair 144. Similarly, the above limit sensing NOR gates 128 and 130 of the adjusting circuit A for each of the level intensity background removal amplifiers B are electrically connected in parallel through a group of parallel connected diodes 148 to an inverter 150 to enable an up count control gate 151 of the down/up selector 144.

Timing control of the adjusting circuit A includes a master oscillator or clock 152 which forms system clock pulses for the processing circuit P at a suitable frequency, such as three-hundred hertz, as indicated by a waveform 152 when enabled by a Low Reset pulse waveform 154 (FIG. 10) formed in control circuit K in a manner to be set forth. A monostable multivibrator 156 forms a Count pulse waveform 158 at each trailing or falling edge in the waveform 152. A monostable multivibrator 160 forms a gate check waveform 162 on each rising or leading edge of the waveform 152. The gate check waveform 162 is furnished to a bi-stable multivibrator 164 which is also connected to the detector NAND gate 116 so that the status of multivibrator 164 is indicative of the output of gate 116. Finally, a monostable multivibrator 166 is connected to the multivibrator 160 and forms a status set waveform 168 in the form of a series of pulses, each occurring at the end of a preceding pulse in the gate check waveform 162.

A diode 169 is connected to the output of monostable multivibrator 160 while a diode 170 is connected to the output of monostable multivibrator 166 to cause a status check waveform 172 to be presented to a NAND gate 174. The NAND gate 174 investigates the status of bi-stable multivibrator 164 in response to the positive-going trailing edge of each successive pulse of waveform 172. Gates 116 and 174 together with multimotors 164 and 176 form a decision logic cicuit to determine if the sampled background levels need adjustment. When a background removal amplifier is indicated not to be in tolerance, the output of gate 174 is driven high causing a bi-stable multivibrator 176 to remain in the state it was set in by waveform 168. The bi-stable multivibrator 176 thus permits a NAND gate 178 to pass count pulses of waveform 158 to the down/up selector 144 and a two-stage recalibration counter 180 composed of counter stages 182 and 184. Counting, either up or down, as indicated continues until the amplifier being scanned is indicated in tolerance. NAND gate 186 is simultaneously disabled during counting so that clock pulses are inhibited from passing through it.

If an amplifier being scanned is indicated to be in tolerance, either without adjustment or after adjustment, the NAND gate 186 is enabled since gate 174 has caused multivibrator 176 to change state. NAND gate 186 then permits a single count up pulse of waveform 158 to be passed to increment contents of a channel or address counter 188 (FIG. 6).

Figure 10:
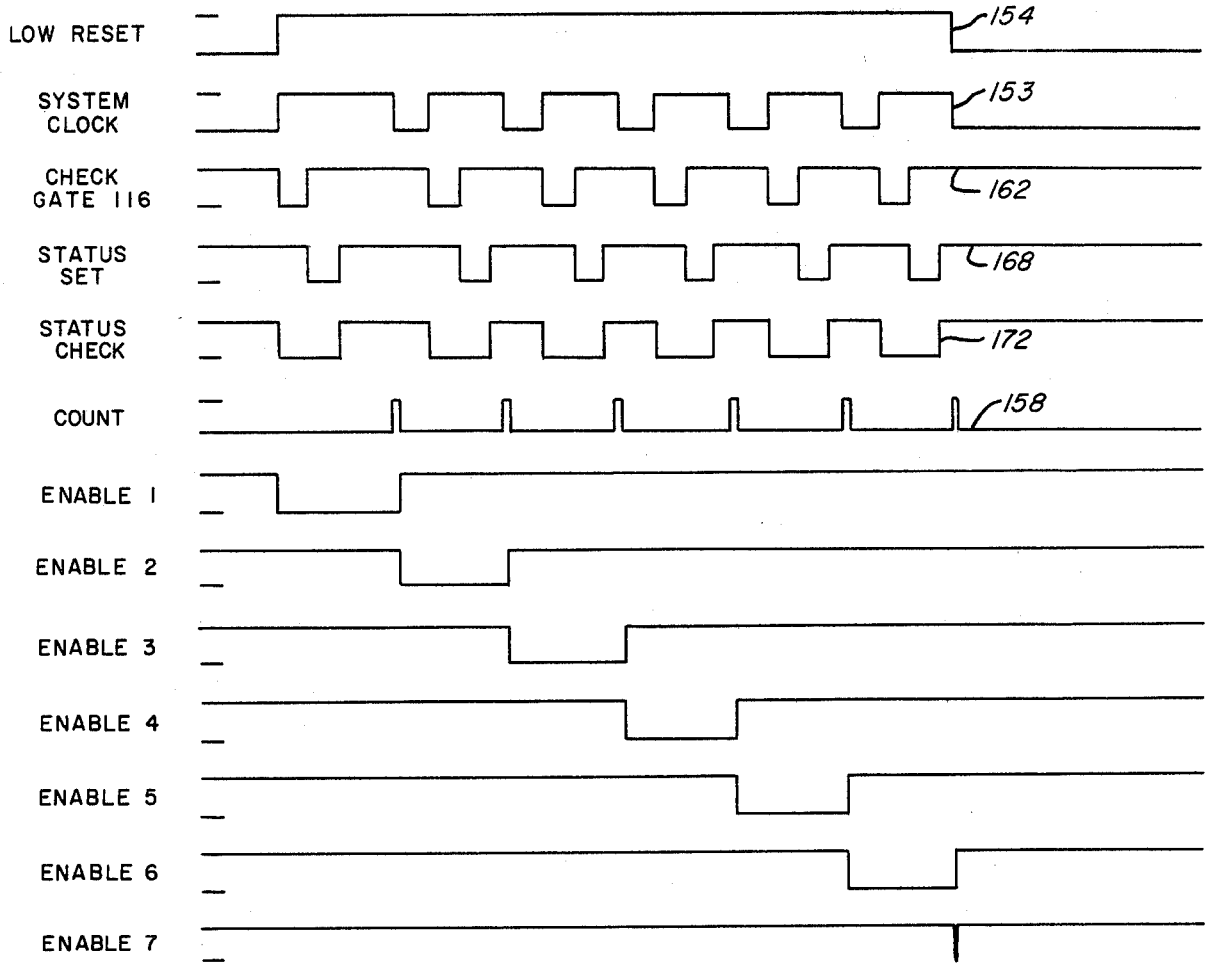
FIGS. 10 and 11 are electrical signal waveforms present in the circuit of FIGS. 5, 6, 7, 8 and 9 at various times of the operating cycle of the sorting apparatus of FIG. 1.
Figure 11:
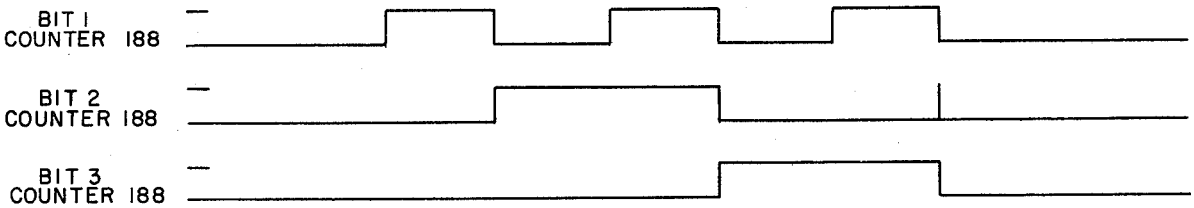

Channel counter 188 forms a sequence of digital counts of three bits (FIG. 11) from one to seven which are decoded by a decoder 190 to form a sequence of seven Enable pulses, Enable 1 through Enable 7, inclusive (FIG. 10). The first six of such enable pulses sequentially electronically connect with and scan the background reduction amplifiers for each color component of each viewing channel in the sorter S. The final enable pulse, Enable 7, is a resetting pulse used to reset operating conditions in the operating control circuit K after a recalibration cycle so that sorting operations may again resume.

Recalibration counter 180 (FIG. 8) forms a digital count representing a specific amplitude setting which is furnished over a pair of buses, bus 1 and bus 2 sequentially to a storage register 192 (FIG. 6) for the adjustment circuit A for each color component of each color signal. If the background comparator amplifier B for such color component is determined to be within tolerance, no change in the contents of the register 192 is made because no adjustment is needed. Should the background comparator amplifier B for a particular color component be determined not to be within tolerance, the contents of the storage register 192 are adjusted by the counter 180 by counting either upwardly or downwardly, as controlled up/down selector 144, until the amplitude setting of the particular amplifier is within tolerance. The digital count stored in each of the count registers 192 is converted to an analog output signal in a converter 194 and furnished as an input to the signal background amplifier B associated therewith.

The operating control circuit K (FIG. 9) controls the overall operating cycles of the sorter S, as has been set forth. A monostable multivibrator 200 establishes a suitable time limit, such as several minutes, during which normal sorting operations occur. The multivibrator 200 is triggered by a multivibrator 202 in response to the formation of the Enable 7 pulse (FIG. 10) from the decoder 190 (FIG. 6) at the end of each recalibration operation. Multivibrator 200 may be disabled and inhibited from operating by an operator of the sorter S by depressing a manual normalization switch 204 or a feeder control switch 206. The manual recalibration switch 204 is electrically connected to a monostable mulitvibrator in a logic circuit 208, which forms a pulse furnished through a gate in logic circuit 208 to disable the multivibrator 200 as well as multivibrator 210 and 212 if the feeder control switch 206 is off or grounded.

The feeder control switch 206 is electrically connected through a gate in the logic circuit 208 to a gate 214 connected between the multivibrator 200 and 210 and when open or on causes the gate 214 to trigger the monostable 210 and thereafter monostable 212.

During normal operations, at the expiration of the time limit set by the multivibrator 200, a pulse is formed and passes through the NAND gate 214 causing the multivibrator 210 to form an output pulse of a suitable duration, such as one or more seconds, for product to empty from chute 14.

The multivibrator 212 is activated for a short time, such as one or more seconds, at the end of the pulse formed by the multivibrator 210 to permit a blast of air to clear the viewing station V of dust and debris to the extent possible. The pulse formed in the multivibrator 212 is furnished to an electrical or electronic switch 216 which activates an air solenoid, permitting a blast of air to be blown through the viewing station V prior to recalibration operations.

A re-calibrate Enable gate 218 is electrically connected through an inverter 220 to the monostable 200 and directly to the monostables 210 and 212 so that at the end of the period of time set by the time constants of the three monostables, the low reset pulse waveform 154 (FIG. 10) is formed by an inverter 222 enabling re-calibration operations to begin. A feeder inhibit gate 224 is electrically connected to the monostables 210 and 212 so that, via an inverter 226, a gate 228 and an inverter 230 inhibit operation of the feeder 12 during the time that the remaining product in the chute is falling from the chute 14, and also during the time that the air solenoid is activated to clear the chute 14 and viewing station V.

Gate 228 is also electrically connected at an input terminal to the feeder inhibit gate 218 so that the feeder 12 is rendered inactive during re-calibration. The gate 228 is also connected at an input terminal to a lamp failure detector circuit 232 to inhibit operation of the feeder 12 in the event that any of the illuminating lamps in the viewing station V should fail. The lamp failure circuit 232 may be, for example, a resistor electrically connected in series with the lamps and a voltage detector to detect interruption of current flow through the lamp associated therewith and drive the output of the lamp failure detector 232 furnished to the gate 228 to a low condition, inhibiting the feeder through a feeder activator circuit 234.

The feeder activator circuit 234 is conventional and permits the feeder to operate through a feeder control circuit 236. The amplitude of vibrations of the feeder 12 may be adjusted, if desired, by a vibration control knob 238 associated with the feeder control 236.

In the ejector circuit E (FIG. 9) an inhibit logic circuit 240 receives an overall trip signal from the OR gate 80 in the event of detection of an unacceptable color characteristic in an agricultural product in the viewing station V by any one of the particular viewing channels. The inhibit logic circuit 240 may be of the form of a pair of parallel connected electronic switches or transistors which inhibit the passage of trip pulses through the logic 240 and inhibit operation of the ejector as the chute 14 is being cleared and also during recalibration operations.

During normal sorting operations, however, logic circuit 240 is inactive and any trip pulse from the OR gate 80 passes into a shift register 242 driven by a clock or oscillator 244. The trip pulse presented to the ejector control circuit E from the gate 240 passes through the shift registor 242 for a time controlled by the number of stages in shift register 242 and the frequency of pulses from the oscillator 244. In this manner, the time interval for the unacceptable product to pass from the viewing station V to the ejector 18 may be set and established. The frequency of the oscillator 244 may be adjusted by a delay control knob 246. The overall trip pulse after passage through the shift register 242 activates a monostable multivibrator 248 which controls the time that the ejector 18 is activated in response to each trip pulse. The duration of this time may be adjusted by a control knob 250. The trip pulse passing from the shift register 242 also passes through a bypass inverter 252 enabling the ejector to remain activated in the event that the trip pulse formed in the processing circuit P is longer in time duration than the time constant of the monostable multivibrator 248. The output of the monostable 248 and the inverter 252 are passed through an OR gate 254 to activate a power switch 256 which causes the ejector 18 to separate the unacceptable product from the acceptable.

In the operation of the present invention, products to be sorted are loaded into the hopper 10 and moved therefrom by the feeder 12 through the chute 14 past the viewing station 16. Portions of individual ones of the product are optically framed in the optical system O and thereafter split into color component levels. These color component levels are compared with background adjusted reference levels in the processing circuit P to determine whether or not the color characteristics of the ones of the product are within acceptable limits. For those ones of the products not within acceptable color limits, the processing circuit P activates the ejector control circuit E to separate the unacceptable ones of the product from those having acceptable color characteristics. Sorting of the product continues for the time duration set in the monostable multivibrator 200 of the operating control circuit K. After this time limit elapses and the viewing station V is cleared by a blast of air, re-calibration of the background reference amplifiers occurs.

The control circuit K enables the counter 188 via the inverter 222, starting a re-calibration cycle. During the re-calibration cycle, the background level amplifiers B for each component color of each channel are compared with actual ambient optical conditions in the viewing station 16 to determine whether or not the background reference levels for such amplifiers are within acceptable limits of tolerance. It is important to note that this comparison is done in a sequential manner for each set of amplifiers for each component color in each channel. In this manner, a single adjusting circuit A may be used, permitting a manifest reduction in the number of component electronic parts over the prior art and greatly simplifying field operations according to the present invention.

In the event that the background settings for a particular color component for a particular channel are found to be normal, the counter 188 is incremented and the next component color or next channel in the sequence is then investigated. In the event that a setting for optical background intensity for a component color is determined to be out of acceptable limits of tolerance for a particular channel, the contents of the counter 180 are increased or decreased as need be under control of up/down selector 144, until the background setting for the particular amplifier is within acceptable limits. Once the background setting for the amplifier B in question has been brought within acceptable limits, address counter 188 is then incremented and amplifiers for a new component color of a channel are then addressed by the decoder 192.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

I claim:

1. A sorting apparatus for sorting agricultural products into acceptable and unacceptable categories based on color characteristics of surface areas of the products as they descend in a chute or conduit through a zone of illumination in a viewing station, comprising:

(a) plural optical sensor station means comprising optic fiber means spaced at intervals with respect to the periphery of the viewing station for sensing the light reflected from spaced illuminated surface areas of successive band portions of the product in the zone of illumination;

(b) optical divider means optically coupled to said optic fiber means for dividing the sensed light from the spaced illuminated surface areas of the product into plural color illumination level components;

(c) means for converting the plural color illumination level components of the sensed light into electrical component level signals;

(d) processing circuit means for comparing the component level signals with reference levels to determine if the color of the individual ones of the product is within acceptable limits; and (e) ejector means for separating unacceptable ones of the product from those which are acceptable.

2. The apparatus of claim 1, further including:

means for focusing light from the zone of illumination onto said optic fiber means.

3. The apparatus of claim 2, wherein said means for focusing comprises:

lens means for optically reducing the framed image of the successive portions of the product.

4. The apparatus of claim 1, wherein said optical divider means includes:

(a) splitting mirror means for splitting the sensed light into plural beams;

(b) filter means for filtering the plural beams into different color illumination level components.

5. The apparatus of claim 1, wherein said means for converting comprises:

a photodiode.

6. The apparatus of claim 1, wherein said optic fiber means comprises:

a plurality of optic fibers mounted with ends in alignment to sense a light reflected in a planar section of the zone of illumination.

7. The apparatus of claim 6, wherein:

said plurality of optic fibers extend from the zone of illumination to said optical divider means.

8. The apparatus of claim 7, wherein:

said plurality of optic fibers are mounted with ends adjacent said optical divider means, with at least one of said fibers being centrally located and the remaining ones of said fibers being wrapped in a circular manner thereabout.

9. The apparatus of claim 1, wherein said processing circuit means comprises:

(a) comparator circuit means for each of said plural sensor station means for comparing the component level signals with reference levels to determine if the color of the portion of the product presented to the sensor is within acceptable limits;

(b) said means for sensing light also comprising means for periodically sampling the background light conditions in the zone of illumination in the absence of product to obtain a background reference level;

(c) means for storing an electrical signal representing a background adjustment based on the background reference level;

(d) means for each of the plural sensor station means removing the stored background adjustment from the component level signal;

(e) means for adjusting the background adjustment stored in said means for storing based on variations in the periodically sampled background reference level; and (f) means for sequentially electronically connecting said means for adjusting with each of said means for removing.

10. An apparatus for sorting agricultural products into acceptable and unacceptable categories based on color characteristics of the products as they descend in a chute or conduit through a zone of illumination, comprising:

(a) means for sensing the light reflected from successive portions of the product in the zone of illumination at plural sensors about the periphery of the zone of illumination;

(b) means for dividing the sensed light from the portions of the product into plural color illumination level components;

(c) means for converting the plural color illumination level components of the sensed light into electrical signals;

(d) comparator circuit means for each of said plural sensors for comparing the component level signals with reference levels to determine if the color of the portion of the product presented to the sensor is within acceptable limits;

(e) said means for sensing light also comprising means for periodically sampling the background light condition in the zone of illumination in the absence of product to obtain a background reference level;

(f) means for storing an electrical signal representing a background adjustment based on the background reference level;

(g) means for each of the plural sensors for removing the stored background adjustment from the component level signal;

(h) means for adjusting the background adjustment stored in said means for storing based on variations in the periodically sampled background reference level; and (i) means for sequentially electronically connecting said means for adjusting with each of said means for removing.

11. The apparatus of claim 10, wherein said means for adjusting the reference levels comprises:

(a) level setting means for selectively increasing or decreasing the sampled background level;

(b) control means for causing said level setting means to increase the sampled background level when required and to decrease the sampled background level when required.

12. The apparatus of claim 10, further including:

decision circuit means for determining if the sampled background levels need adjustment by said means for adjusting.

13. The apparatus of claim 12, further including:

means responsive to said decision circuit means for activating said means for sequentially connecting.

14. The apparatus of claim 10, wherein said comparator circuit means includes:

means for forming at least one reference level for a mixture of illumination component level signals.

15. The apparatus of claim 10, wherein said comparator circuit means includes:

means for forming upper and lower reference levels for a mixture of illumination component level signals.

16. The apparatus of claim 10, further including:

ejector means responsive to said comparator circuit means for separating agricultural products with unacceptable color characteristics.

17. The apparatus of claim 10, wherein the agricultural product falls from the conduit past said ejector means, and further including:

pulse forming means for activating said ejector means for a set time interval in response to said comparator circuit means.

18. The apparatus of claim 17, further including:

means for bypassing said pulse forming means if conditions of unacceptable color characteristics exceed the set time interval of said pulse forming means.

19. The apparatus of claim 10, further including:

means for disabling said comparator circuit means for at least one of said plural sensors.

* * * * *